United States Patent [19]

Bruckner et al.

[11] 3,978,288

[45] Aug. 31, 1976

[54] METHOD AND APPARATUS FOR THE SECRET TRANSMISSION OF SPEECH SIGNALS

[75] Inventors: Markus Bruckner, Basel; Gustav Guanella, Zurich; Claude Andre Vouga, Baden, all of Switzerland

[73] Assignee: Patelhold Patentverwertungs- und Elektro-Holding AG, Glarus, Switzerland

[22] Filed: June 5, 1974

[21] Appl. No.: 476,469

[30] Foreign Application Priority Data

June 12, 1973 Switzerland ..... 8347/73

[52] U.S. Cl. ..... 179/1.5 R; 179/1.5 E

[51] Int. Cl.[2] ..... H04K 1/02; H04K 1/06

[58] Field of Search ..... 179/1.5 R, 1.5 E; 178/22

[56] References Cited

UNITED STATES PATENTS

| | | | |
|---|---|---|---|
| 2,107,756 | 2/1938 | Kendall et al. | 179/1.5 R |
| 2,405,599 | 8/1946 | Mitchell | 179/1.5 R |
| 2,932,693 | 4/1960 | Wilcox, Jr. | 179/1.5 R |
| 3,399,273 | 8/1968 | Vasseur | 179/1.5 R |

*Primary Examiner*—Howard A. Birmiel
*Attorney, Agent, or Firm*—Frank L. Durr; Orville N. Greene

[57] ABSTRACT

Method and apparatus for enhancing the secret (confidential) transmission of voice (speech) type signals. The voice signals are encoded at a transmitter facility. Filling signals are inserted into breaks and interruptions normally encountered between words and/or phrases. Such breaks and interruptions may be either partially or completely filled with the filling signals which preferably correspond as close as is practical to the characteristic of either coded or uncoded voice signals with regard to time variation and spectral energy distribution and the filling signals may be derived from voice signals of either the coded or uncoded type which are at least temporarily stored by the transmitter facility. The resultant signal having either shortened or completely eliminated breaks and interruptions is then encoded and transmitted to a remote location. Alternatively, the voice signals may be intially encoded before the insertion of filling signals into the breaks and/or interruptions. Reversal of the operations performed at the transmitter facility takes place at the remote receiver facility in order to recover the original voice signals. A signal which controls the insertion of the filling signals may be transmitted over a separate channel for control of a responsive device at the receiver facility to provide for suppression of filling signals thereat.

Various techniques and apparatus are described for achieving the above objectives.

16 Claims, 19 Drawing Figures

FIG.1
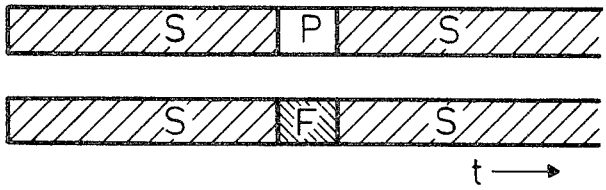
FIG.2
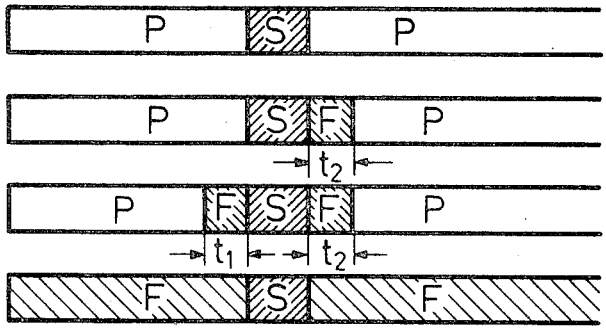
FIG.3
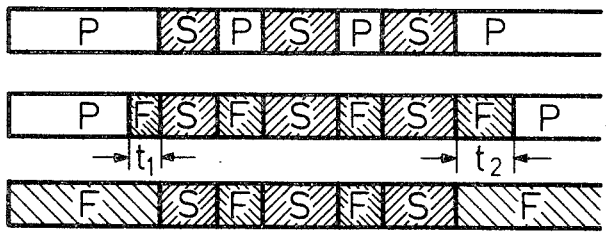
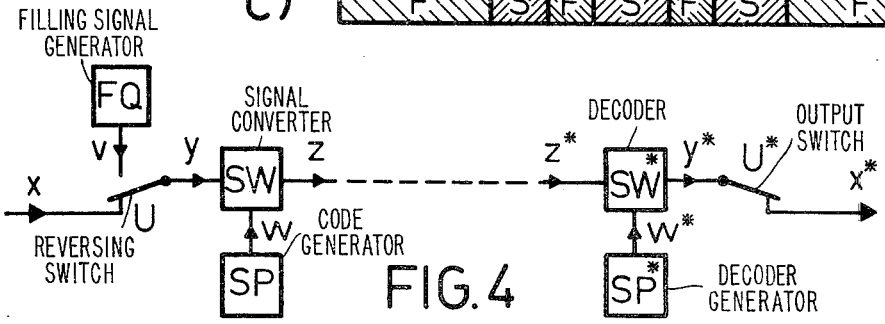
FIG.4
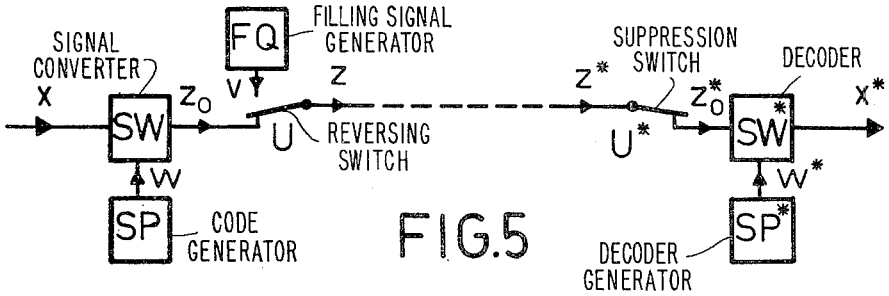
FIG.5

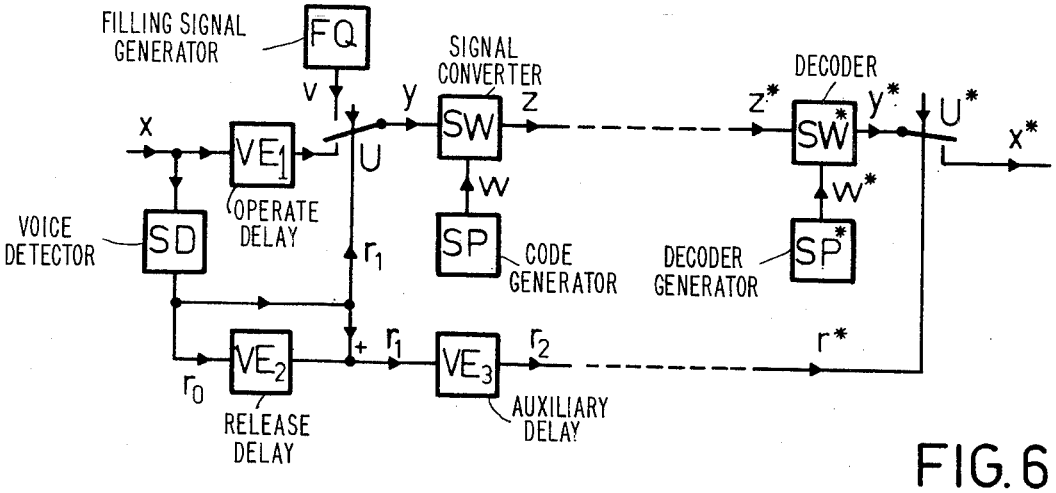
FIG. 6
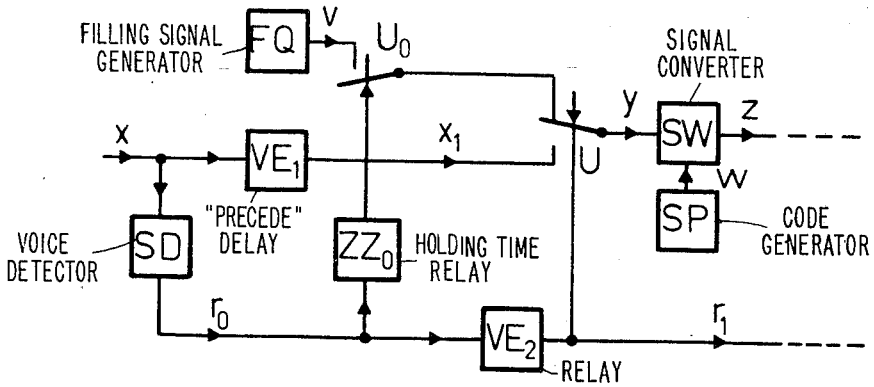
FIG. 7
FIG. 8
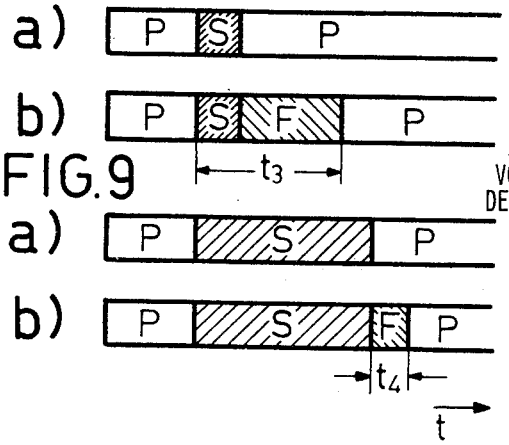
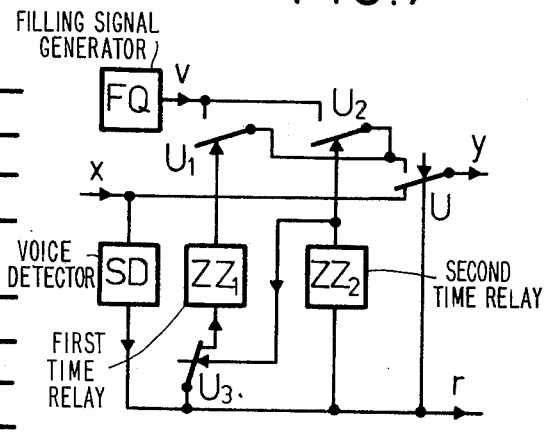
FIG. 10

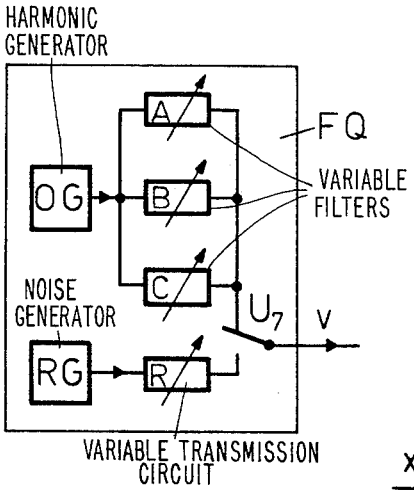
FIG.15
FIG.16
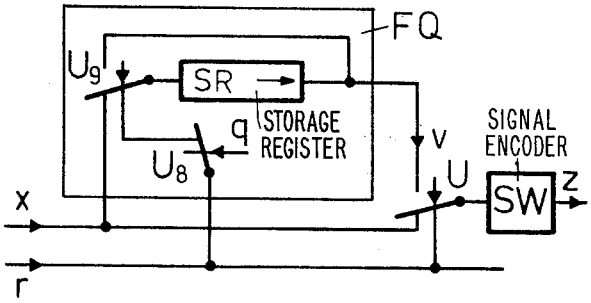
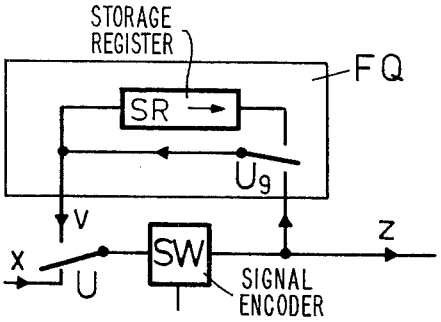
FIG.17
FIG.18
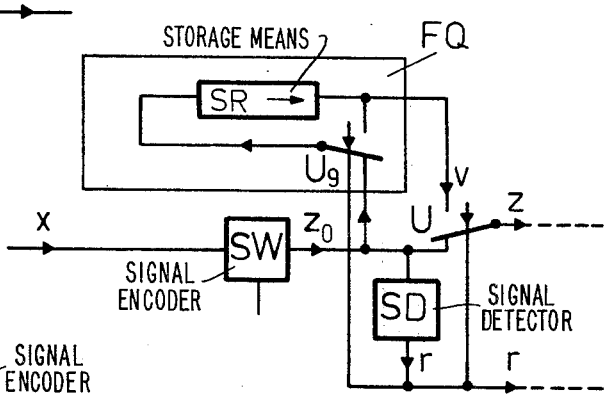
FIG.19
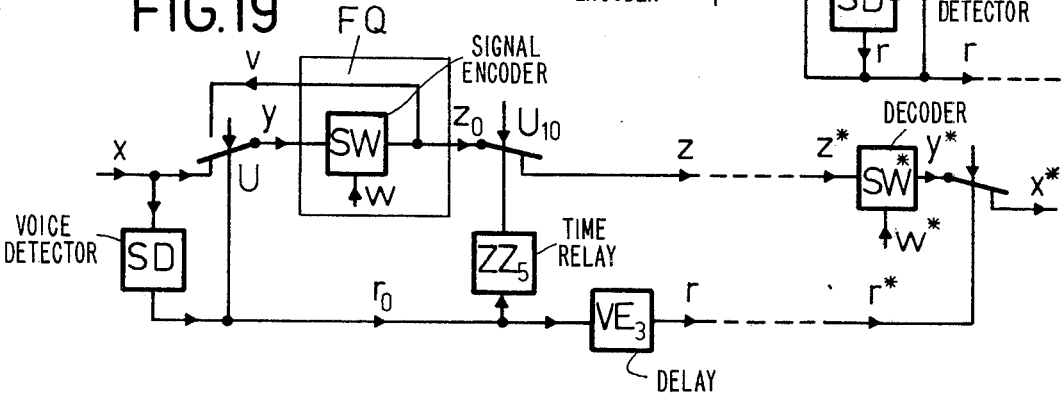

METHOD AND APPARATUS FOR THE SECRET TRANSMISSION OF SPEECH SIGNALS

The present invention relates to voice transmission especially of the secret or confidential type and more particularly to a transmitter-receiver system in which the breaks and interruptions normally encountered in speech are partially or completely filled by filling signals which, together with encoding of the voice signals and/or the filling signals serves to enhance the confidentiality of the transmission.

BACKGROUND OF THE INVENTION

The present invention relates to a method and apparatus for the confidential transmission of voice signals by encoding such signals at a transmitter facility and by decoding the encoded signals at a receiver facility.

In the confidential transmission of voice signals, a reduction of the level of confidentiality may occur by the presence of breaks or interruptions of the voice signals. The breaks appearing between individual syllables or words of the audio signal are not masked by present day coding methods, for example alternating the interchange of individual partial frequency bands, and as a result the voice signal portion of transmission can be recognized within the coded signal. Assumptions regarding the spoken text can be derived from the duration and frequency of the breaks. The length and exact position of an individual spoken word can be exactly determined and an unauthorized person may then concentrate on any additional recognition methods on this isolated word in order to decode it as quickly as possible.

Even through the use of more effective coding methods, wherein voice signals are decomposed into scanning values whose coding is effected, for example, by amplitude variation corresponding to alternating code signals, breaks and interruptions can still have a harmful effect since the coded signals corresponding to the signal gaps permit direct conclusions upon the respective code signals used, whose recognition is undesirable in view of possible insight into the principles and techniques employed into the production of the coded signals.

BRIEF DESCRIPTION OF THE INVENTION

The above disadvantages of present day coding methods are avoided in accordance with the principles of the present invention in that the breaks and interruptions of the intelligence signals containing the voice information are filled at the transmitter end at least partially by additional signals (filling signals) which are suppressed at the receiver facility in order to recover the original voice signals. These intelligence signals may be the uncoded voice signals or voice signals which have already been at least partially encoded. The recognition of the time position individual syllables or words in the coded signals is thereby prevented or at least made extremely difficult by the addition of filling signal and even individual spoken words can no longer be defined with regard to exact length and position. Also, conclusions regarding the respective coding technique employed are no longer readily possible once all breaks and interruptions have been masked by the insertion of filling signals.

BRIEF DESCRIPTION OF THE FIGURES AND OBJECTS

It is therefore one object of the present invention to provide a novel technique and apparatus for insuring the confidentiality of voice transmission through the employment of filling signals which are inserted during breaks and interruptions normally encountered in speech, which technique is employed in conjunction with the encoding of either the voice signals and/or the filling signals thereby providing a higher level of confidentiality of transmission.

Still another object of the present invention is to provide a novel method and apparatus for increasing the level of confidentiality of voice transmission and reception in which filling signals are employed to either partially or fully fill breaks and interruptions normally encountered in speech and in which auxiliary signals are transmitted to a receiver facility for controlling suppression of the filling signals at the receiver end in order to recover the identical voice signals transmitted.

The above as well as other objects of the present invention will become apparent when reading the accompanying description and drawings in which:

FIGS. 1–3, 8, 9 and 13 show a plurality of formats of voice transmission which are useful in describing the principles of the present invention.

FIGS. 4 and 5 are simplfied block diagrams showing fundamental techniques employed in carrying out the fundamental principles of the present invention.

FIGS. 6, 7, 10–12 and 14–19 show block diagrams of various embodiments of the present invention.

DETAILED DESCRIPTION OF THE INVENTION

Figure 11:
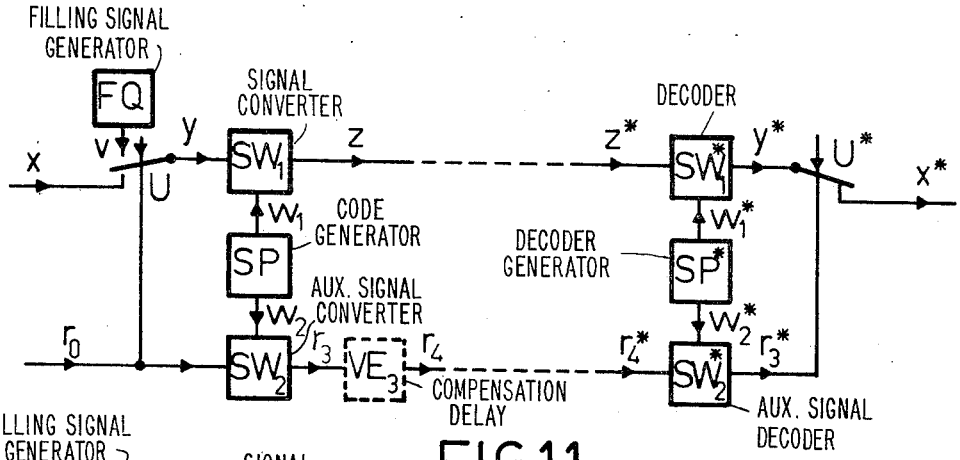

Voice signals are represented schematically in FIGS. 1 to 3 by hatched area S, operated on by breaks P and the subsequently added filling signals F. A short break P between two voice signals according to FIG. 1*a* is masked according to FIG. 1*b* by the filling signal F. A short voice signal S according to FIG. 2*a* appearing between longer breaks P can be extended according to FIG. 2*b* by a following time-limited filling signal F. Another filling signal which precedes the voice signal suffices according to FIG. 2*c* to substantially prevent determination of the exact location and length of the voice signal. More difficult are the location and determination of the length of time-unlimited filling signals according to FIG. 2*d*. A sequence of voice signals S with brief interruptions P is shown in FIG. 3*a*. By time-limited filling signals the short breaks and also the end zones of longer breaks can be completely masked according to FIG. 3*b*. Complete masking of all interruptions is again possible by unlimited filling signals according to FIG. 3*c*. With coding methods which do not influence the energy distribution in time, the breaks and interruptions are not changed by the coding process. This is the case, for example if partial frequency bands of the voice signals are interchanged. In these cases the representations shown in FIGS. 1–3 apply unchanged also to the corresponding encoded signals. But when the time sequence of signal sections is interchanged by the coding process, the breaks, voice signals and filling signals appear after the coding in a different sequence of sections. Here too, the addition of filling signals prior to encoding results in an extensive masking of all interruptions which would otherwise facilitate recognition. Of particular importance in this time coding is the effective masking of the signal-free regions appearing at both sides of the single word according to FIG. 2*a*, because a recognition or assumption of isolated words can be possible, as experience has shown because of the recognizability of the typical vowel content, which is not prevented, despite the interchange of the time sequence. This is prevented, however, or at least made more difficult, by embedding the word in additional voice-like filling signals.

The effect of the filling signals is principally achieved when these signals are added before encoding or after partial or complete encoding. But the filling signals should correspond as much as possible to the characteristic of the uncoded or coded voice signals with regard to time variation and spectral energy distribution. It seems therefore, particularly advisable to obtain the filling signals from stored — coded or uncoded — voice signals of the respective transmission.

The realization of a coded transmission according to the invention can be seen from the block diagram of FIG. 4. During breaks of the voice signal $x$ fed to the transmitter, sections of the filling signal $v$ supplied by the filling signal generator FQ are selectively coupled to signal converter SW by actuating the reversing switch U. The signal $y$ thus formed, with shortened or completely eliminated breaks, is encoded in the signal converter SW, so that an unintelligible signal is formed, which is transmitted to the receiver. Encoding can be effected by amplitude variation of scanning values, by interchanging partial frequency bands, by interchanging the time sequence of individual sections or by any other known method. Encoding is controlled by irregularly alternating code signals $w$ which are generated by block SP. Suitable coding methods are described for example, in Swiss Pat. Nos. 238,926; 361,597; 361,839 and 518,658. The received signals $z$ are decoded by signal conversion in block SW* through the use of code signals $w$ identical to signals $w$, are generated in block SP* in the same manner as block SP in the transmitter. The signals $y$ thus obtained correspond to a great extent to the signals $y$ at the transmitter end. The filling signals contained therein are suppressed by the interrupter U*, so that finally an output signal $x$ corresponding to the original voice signal $x$ is recovered. The switches U and U* must naturally be actuated in synchronism taking into account the entire signal transmission time.

In the apparatus according to FIG. 5 the voice signals $x$ are fed directly to the signal converter SW for coding without filling signals. The converter is again controlled by the coded signals $w$ which are generated in SP. The signals $Z_o$ coded for example, by interchanging partial frequency bands or by interchanging the time sequence of individual sections, still have breaks or interruptions similar to the original voice signal $x$. These intervals are occupied at least partly by filling signals $v$ from the filling signal generator FQ. The reversing switch U is coupled to FQ during the signal gaps. The switch U* at the receiver end must be actuated in synchronism with U, taking into account the transmission time, to suppress the filling signals contained in the receiving signal $z^*$. The remaining encoded voice signal $Z_o^*$ is then decoded in the signal converter SW*, so that the intelligible voice signals $x^*$ are formed again. The device shown in FIG. 5 can be supplemented at the transmitter end by coding the signal $z$ again. An additional decoding at the receiver and must then precede the interrupter U*. In this case the filling signal is thus supplied between two coding processes, while the suppression of the filling signal at the receiver end takes place between two decoding processes.

The control of the interrupter U at the transmitter end can be effected according to FIG. 6 by an auxiliary signal $r_1$ obtained by rectifying voice signals $x$ in voice detector SD. The operating time $t$ of an additional signal retarder $VE_1$ corresponds substantially to the response time of the voice detector SD, so that the disconnection of the filling signal takes place simultaneously with the start of the voice signal. A slight additional interruption to clearly separate the two signals can be easily achieved by extending the delay correspondingly in $VE_1$. At the end of the voice signal, the interrupter U should not return immediately to the rest position, because of the voice delay in $VE_1$. A corresponding release lag of the voice detector SD or an additional delay of the auxiliary signal $r_o$ in the delay element $VE_1$ should therefore be provided, so that the auxiliary signal $r_1$ disappears only after a predetermined time interval after the end of the voice signal. The auxiliary signal $r_1$ is conducted, for example, over a separate channel to the receiver, where the corresponding signal $r^*$ controls the interrupter $u^*$. In view of a delay of the voice signal by the encoding process at the transmitter and by the decoding process at the receiver, an additional delay of the auxiliary signal $r_1$ conducted to the receiver may be desirable. This is effected with the delay element $VE_3$ whose output signal $r_2$ is delayed relative to $r_1$, corresponding to the coding transit time. The other parts and designations of the apparatus correspond to FIG. 4.

In the device according to FIG. 6 the signal interruptions are filled completely by filling signals according to FIG. 2*d* and 3*c*. Filling signals of limited duration as are shown in FIGS. 2*b*, 2*c* and 3*b* are obtained by the circuit of FIG. 7. If the response time of the voice detector SD is neglected, the delay time of the delay element $VE_1$ is identical with the desired duration $t_1$ of the filling signal preceding the voice signal. (See FIGS. 2*c* and 3*b*). Corresponding to this delay time, the auxiliary signal $r_o$ leads the voice signal $X_1$. The auxiliary signal actuates the reversing switch $U_o$, so that a filling signal is conducted over the reversing switch U, shown still in rest position, to the coding device SW. After time $t_1$, the auxiliary sign $r_1$ appears at the output of the delay element $VE_2$ whose transit time is likewise identical with $t_1$. The reversing switch U is thus brought into the working position so that the simultaneously appearing voice signal arrives in the coding device SW. At the end of the voice signal the delayed voice signal $X_1$ and the delayed auxiliary signal $r_1$ disappears likewise with a delay of $t_1$. The holding time of the time relay $ZZ_o$ is $t_1 + t_2$, however, so that an interruption of the filling signal is effected by the reversing switch $U_o$ with a delay of $t_2$ relative to the delayed voice signal $X_1$. The latter is therefore supplemented by a trailing filling signal of duration $t_2$ (see FIGS. 2*b*, 2*c*, 3*b*). In order to avoid the leading filling signal, the delay elements $VE_1$ and $VE_2$ must be eliminated.

A very short duration of the trailing filling signal may be desirable in view of a trouble-free communication. But in order to keep individually spoken words confidential, the total duration of a short word and of the following filling signal should not be too short. We arrive thus at the requirement of a certain minimum duration $t_3$ of voice signal and filling signal according to FIGS. 8*a* and 8*b*, while with longer voice signals a minimum duration $t_4$ of the following filling signal suffices, as can be seen from FIGS. 9*a* and 9*b*. These requirements are met by the circuit of FIG. 10. At the start of the voice signal $x$, the auxiliary signal $r$ developed by voice detector SD is coupled by switch $U_3$, which is at first closed, to the time relay $ZZ_1$ which moves switch $U_1$ from the represented rest position immediately into the working position. The filling signal $v$ from filling signal generator FQ is coupled to switch U and is transmitted over this switch at the end of a short voice signal until the holding time $t_3$ of the time relay $ZZ_1$ has elapsed. The filling signal F shown in FIG. 8*b* thus continues until the required minimum time $t_3$ of voice- and filling signal has been attained. After longer voice signals, however, a filling signal with the minimum duration $t_4$ according to FIG. 9 will appear, because a time relay $ZZ_2$ is released by the interrupting auxiliary signal $r$ at the end of the voice signal, which brings the switch $U_2$ with a holding time $t_4$ into working position. Over this switch and the reversing switch U, which is in rest position, the filling signal is transmitted during the limited time $t_4$. The interrupter $U_3$ is actuated by relay $ZZ_2$ during short voice breaks. This has the effect that the voice signals appearing occurring again after short breaks do not release the relay $ZZ_1$ again and again.

An unauthorized person could recognize from the transmitted auxiliary signals $r$ which parts of the transmitted signal consist of filling signals, and he could thus eliminate these filling signals in a simple manner. For this reason additional coding of the auxiliary signals is desired, for example, with the device of FIG. 11. It is assumed here that an auxiliary signal $r_o$ indicating the voice signals is started by the speaker with a voice key. This signal actuates reversing switch U in the above described manner to feed auxiliary signals $v$ during speaking breaks. This signal is coded in signal converter $SW_2$ before it is transmitted to the receiving device, for example by reversing the polarity under control of the additional code signal $W_2$ generated in SP. For compensating any additional delay of the voice signals by the coding and decoding, a delay element $VE_3$ can be provided in the transmission channel of the auxiliary signal. The received auxiliary signal $r_4$ is decoded at the receiver end in signal converter $SW_2$*, so that an auxiliary signal $r_3$* identical to $r_o$ is formed to control interrupter U*. When the auxiliary signal is encoded at the transmitter by reversal of polarity, decoding at the receiver end is likewise effected by polarity reversal controlled by code signal $W_2$*, which is identical to the code signal $W_2$ at the transmitter end. The code signal generators Sp and SP* are preferably designed so that code signals $W_1$ and $W_2$ are not identical, while the associated code signals $W_1$ and $W_1$* as well as $W_2$ and $W_2$* must naturally be identical.

Figure 12:
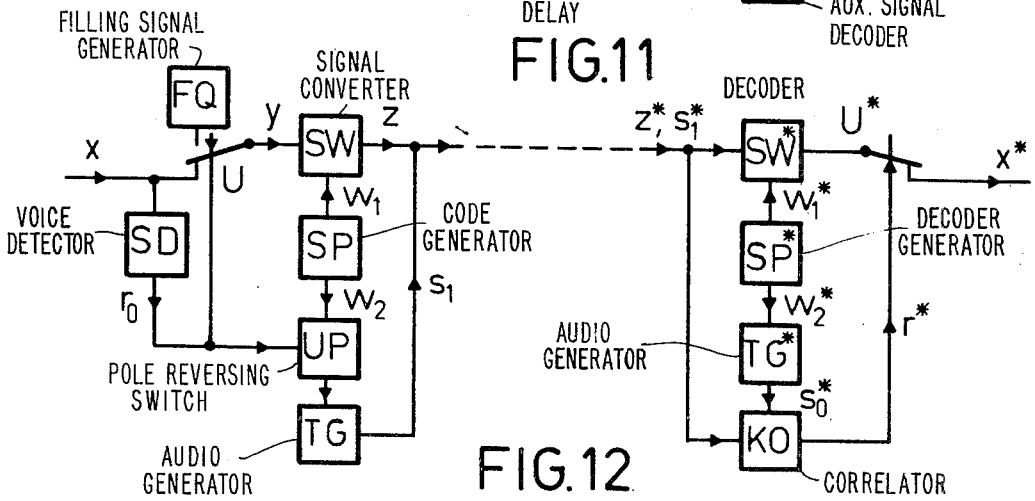

Transmission of auxiliary signal $r$ is also possible by correspondingly scanned sounds, which lie, for example, in a frequency gap of the coded signals. In the device shown in FIG. 12, the polarity of the auxiliary signals $r_o$ is reversed in an irregular manner by the code signals $W_2$ in the pole reversing switch UP at the transmitter end, so that the control of the confidentiality of the filling signal is again ensured. The coded auxiliary signals control sound generator TG whose output oscillation changes between two frequencies. This oscillation $S_1$ is transmitted in a frequency gap of the coded signal $x$ and separated again at the receiver end from this signal by a dividing filter (not shown). The sound generator TG* at the receiver end generates oscillating signals whose frequency is scanned by the code signal $W_2$*. Depending on the signal of the auxiliary signal $r_o$, the frequencies of the received oscillation $S_1$* and of the oscillations $S_o$* generated in TG* are identical, that is by frequency comparison of the two oscillations in the correlator KO, a signal $r$* can be obtained, which corresponds to the auxiliary signal $r_o$ at the transmitter end. The other parts and functions of the device are identical to the device shown in FIG. 11.

Figure 13:
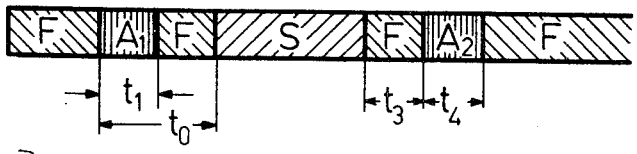
Figure 14:
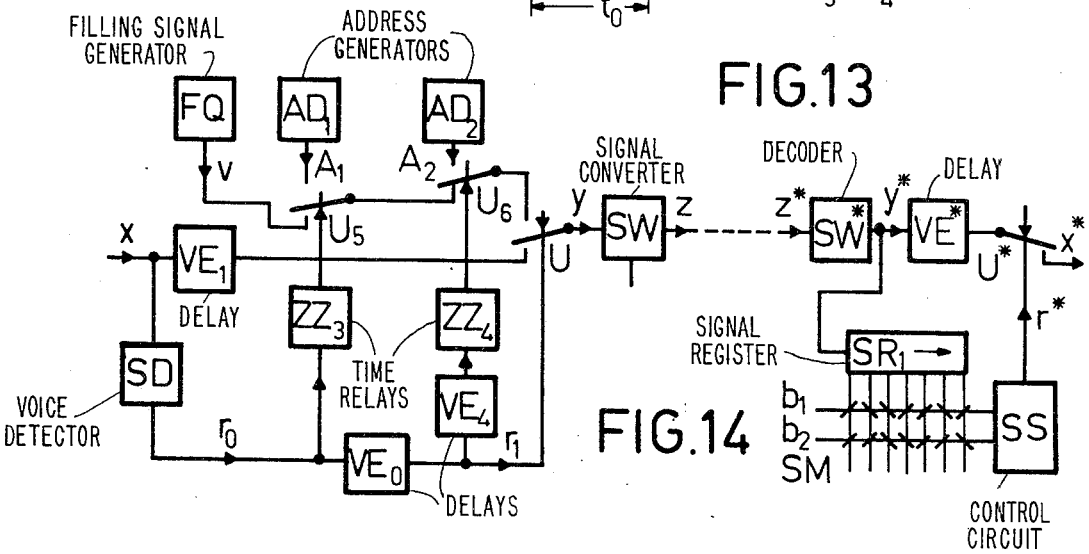

The auxiliary signals can also be marked by special pulse groups which are transmitted in gaps of the coded voice signal and during corresponding interruptions of the filling signal response, as can be seen from a consideration of FIG. 13. The start of a following voice signal S is marked by a pulse group $A_1$, while the end of the voice signal is characterized by a following pulse group $A_2$. A realization of this method is shown in FIG. 14. Neglecting the response time of the voice detector SD, the voice signal in the delay element $VE_1$ and the auxiliary signals in the delay element $VE_o$ are delayed by the same time $t_o$, so that the control of the reversing switch U is effected again by the auxiliary signal at the start and end of the delayed voice signal. At the start of the undelayed voice signal the time relay $ZZ_3$ is already actuated by the auxiliary signal $r_o$, so that the reversing switch $U_5$ moves from the represented rest position during the holding time $t_1$ of $ZZ_3$ into the working position. During this time the pulse sequence $A_1$ marking the start of the signal is coupled from address generator $AD_1$ to switch $U_5$ and the switches $U_6$ and U, which are still in rest position, to the coding device SW. After the holding time of $ZZ_3$ the filling signal $v$ is forwarded again, — as before the start of this holding time — until the delayed voice signal starts when the delay time $t_o$ is reached, and the reversing switch U moves at the same time into working position. At the end of the voice signal, the auxiliary signal $r_1$, which undergoes further delay in the delay element $VE_4$ by the time $t_3$, releases the time relay $ZZ_4$, actuating the reversing switch $U_6$ during the holding time $t_4$. A pulse sequence $A_2$ marking the end of speech is thus transmitted during the time $t_4$ according to FIG. 13. At the receiver end the decoded signals $y$*, which also contain the pulse sequence $A_2$, are fed to a shift register $SR_1$ with several taps to recognize these pulse groups. A first test line $b_1$ is so connected with the output lines of $SR_1$ over rectifiers that a coincidence pulse is formed as soon as the polarity of the rectifiers is identical with the polarity of the arriving pulses. This is the case when the address $A_1$ arrives. In the same manner a coincidence pulse is formed in the test line $b_2$ when the address $A_2$ arrives. The coincidence pulses yield again an auxiliary signal $r$*, after a delay and storage in the control circuit SS, which serves to actuate the switch U* so that the filling signals are suppressed again. In view of the time delay of the pulse sequence $A_2$ relative to the signal end the additional delay of the decoded signal $y$* in the delay element VE* is required. In this device the control pulses, as well as the voice signals and the filling signals are encoded by signal converter SW at the transmitter and are decoded in the signal converter SW* at the receiver.

The device shown in FIG. 14 is particularly suitable for coding methods, where the voice signals are decomposed into scanning values whose coding is then effected by amplitude variation, for example, according to Swiss Pat. No. 361,597 or 411,984. The filling signals $v$ can then consist of a coincidence pulse sequence. After encoding they can no longer be distinguished from the coded scanning values. The same holds true for the address pulse sequences $A_1$ and $A_2$.

With simpler coding methods, like interchanging partial frequency bands or interchanging the time sequence of signal sections, the filling signals should have a course corresponding as far as possible to the course of the voice signals and have a corresponding spectrum response. The generation of the filling signals can be performed by the device of FIG. 15. A harmonic generator OG generates numerous harmonics of a certain fundamental frequency. Variable filters A, B, C select frequency ranges therefrom which correspond to the formants of the human voice. In addition, a certain range can be selected by variable transmission circuit R from a noise signal generator RG. By operation of switch $U_7$, we obtain a change between vocal and non-vocal sounds, which also appears in voice signals. The unavoidable differences relative to voice signals are masked at least partially by the following coding, if the filling signals are added after the voice coding, the signal character, which has been changed by the coding, must naturally be taken into account in the synthesis of the filling signals.

Particularly expedient is the generation of the filling signals from supplied voice signals according to FIG. 16. The voice signals $x$ are intermittently coupled to storage means SR by operation of switch $U_9$, storage means being preferably designed as a shift register for analog signals or as a register for digital signals obtained by the binary coding of scanning values. In order to avoid the storage of signal breaks, it is advisable to control the reversing switch $U_9$ by the auxiliary signal $r$ so that connection into gaps of the voice signal is prevented. An additional interrupter $U_8$, which is controlled by a coincidence signal $q$, can serve to store only fragments of the voice signals. With the signal supply interrupted, output signals of the storage means are returned over the reversing switch $U_9$ to the input, so that the storage means is always filled with signals. The signals $v$ taken from the storage means are always variable, because of the intermittent supply of new voice signals. They serve as filling signals which are transmitted over the reversing switch U in gaps of the voice signals for coding by SW.

Circulating storage SR shown in FIG. 16 can also be employed to fill in voice signals which have already been coded, as is shown in FIG. 17. The reversing switch $U_9$ must be controlled in this case by an auxiliary signal which is formed by rectification of the coded signal, so that refilling of the storage in signal gaps of the coded signal is prevented.

FIG. 18 shows a device where the refilling of the storage means SR is effected again with coded signals, but the filling signals taken from the storage means are added similar to FIG. 5 in gaps of the coded voice signal. Both the reversing switch U feeding the filling signals to gaps of the coded voice signal and the switch $U_9$ for refilling the storage with coded voice signals are controlled by an auxiliary signal $r$ which is generated with the signal detector SD by rectification of the coded signal $Z_o$.

In voice coding by interchanging the time sequence of individual voice sections the coded signals $Z_o$ can be used, in accordance with the arrangements of FIG. 19, simultaneously as filling signals $v$, avoiding additional storage means. The coding device SW, which can be designed, for example, according to Swiss Pat. No. 518,658, contains plural storage means in which the signal sections are delayed by constantly varying amounts for constant interchange. With longer interruptions of the voice signal $x$, the voice signal sections still stored in the coding device are returned in constantly changing order over the reversing switch U as filling signals $v$ to the input of the coding device SW, so that a constantly changing input signal $y$ and a constantly changing output signal $Z_o$ of this device are formed. An additional delay of the auxiliary signal $r$ transmitted to the receiver for the control of the interrupter U* at the receiver end is necessary, because of the signal transit time $t$ of the coding device at the transmitter-and receiver end. The delay element $VE_3$ with the delay time $t$ is provided for this purpose. Additional coding of the auxiliary signal $r$ is also necessary in this circuit even though not especially shown in FIG. 19; such additional coding may be, for example, according to FIGS. 11 or 12. With an interchange of the time sequence of the intelligence elements can also be used the marking of the voice signals by pulse groups, shown in FIG. 14, whose recognition no longer provides an accurate clue for the start and end of the voice signals, because of the interchange of the time sequences. An additional interrupter $U_{10}$ can be used to interrupt the coded signal after the voice signal has been interrupted. The control of this interrupter is effected by means of time switch $ZZ_5$, which responds immediately, but drops with delay, so that all voice sections delayed by the interchange of the time sequences of the time coding in SW are still transmitted. A special advantage of this switch is that a signal interruption can be avoided before the time coding, which would yield after the interchange of the time sequence irregular interruptions of the coded signal, which are undesirable from the viewpoint of confidentiality.

Although the present invention has been described in connection with a number of preferred embodiments thereof, many variations and modifications will now become apparent to those skilled in the art. It is preferred, therefore, that the present invention be limited not by the specific disclosure herein, but only by the appended claims.

We claim:

1. A method for the confidential transmission of intelligence signals comprising a plurality of time intervals of voice signals, each voice signal time interval separated from a next voice signal time interval by an interruption time interval, said method comprising the steps of; encoding each voice signal time interval of the intelligence signal; storing at least a selected one of the encoded voice signals; generating an encoded auxiliary signal during each interruption time interval; filling each interruption time interval of the intelligence signal with the stored encoded voice signal to form a substantially encoded message; transmitting only said message on a first channel; transmitting said encoded auxiliary signal on a separate second channel; receiving the substantially continuous encoded message and encoded auxiliary signals at a receiver end; decoding the encoded auxiliary signal; suppressing the encoded signals occurring during the interruption time intervals at the receiver end by use of the decoded auxiliary signal and decoding the remaining encoded signals.

2. The method of claim 1, further including the step of interchanging the time sequence of each voice signal time interval of the intelligence signal to obtain the other encoded voice signal.

3. A method for the confidential transmission of intelligence signals comprising a plurality of time intervals of voice signals, each voice signal time interval separated from a next voice signal time interval by an interruption time interval, said method comprising the steps of: encoding each voice signal time interval of the intelligence signal; storing at least a selected one of the encoded voice signals; generating an auxiliary signal during each interruption time interval; encoding the auxiliary signal; filling each interruption time interval of the intelligence signal with the stored encoded voice signal to form a substantially encoded message; transmitting only said message on a first channel; transmitting the encoded auxiliary signal on a separate second channel; receiving the substantially continuous encoded message and the encoded auxiliary signal at a receiver end; decoding the encoded auxiliary signal; suppresing the encoded signals occurring during the interruption time interval of the receiver end by use of the decoded auxiliary signal and decoding the remaining encoded signals.

4. A method for the confidential transmission of intelligence signals comprising a plurality of time intervals of voice signals, each voice signal time interval including a plurality of sequential voice signal sections, each voice signal time interval separated from a next voice signal time interval by an interruption time interval, said method comprising the steps of: encoding each voice signal time interval of the intelligence signal by interchanging the time sequence of the plurality of sequential voice signal sections thereof; generating an encoded auxiliary signal during each interruption time interval; filling each interruption time interval of the intelligence signal with encoded voice signals to form a substantially encoded message; transmitting only said message on a first channel; transmitting said encoded auxiliary signal on a separate second channel; receiving the substantially continuous encoded message and the encoded auxiliary signal at a receiver end; decoding the encoded auxiliary signal; suppressing the encoded signals occurring during the interruption time intervals at the receiver end by use of the decoded auxiliary signal; and decoding the remaining decoded signals.

5. Apparatus for the confidential transmission of signals comprising:

transmitter and receiver facilities;

said transmitter facility containing voice information;

means for generating filling signals consisting of coded pulse groups;

switch means coupled between said filling signal generating means and said voice signal transmitting means, said switch means being normally open;

means operative during breaks and interruptions of the intelligence signals containing the voice information for generating an auxiliary signal; .

said switch means being responsive to said auxiliary signal for closing said switch means whereby said coded pulse group filling signals are inserted in said breaks and interruptions;

means for encoding said filled voice signals and said auxiliary signal at the transmitter facility;

said encoded signals being transmitted as a composite signal by said transmitter facility;

said receiver facility comprising means for receiving the composite signals from said transmitter facility;

means for identically decoding the encoded auxiliary signal to provide a decoded auxiliary signal at said receiver end identical to said auxiliary signal before encoding at said transmitter end; and interrupter means coupled to said receiver means and to said auxiliary signal decoder means for supressing said filling signals responsive to said decoded auxiliary signal.

6. The apparatus of claim 5 wherein said receiver facility comprises means for decoding said coded pulse groups to recreate said auxiliary signal.

7. Apparatus for the confidential transmission of signals comprising:

transmitter and receiver facilities;

said transmitter facility containing voice information;

means for generating filling signals;

first switch means coupled between said filling signal generating means and said voice signal transmitting means, said first switch means being normally open;

means operative during breaks and interruptions of the intelligence signal containing the voice information for generating an auxiliary signal;

said first switch means being responsive to said auxiliary signal for closing said first switch means whereby said filling signals are inserted in said breaks and interruptions;

second switch means for interrupting the filling signal during generation thereof;

means for generating a code pulse group corresponding to said auxiliary signal, said second switch means coupling said code pulses to the transmitter;

means for encoding said filled voice signals and said auxiliary signal at the transmitter facility;

said encoded signals being transmitted as a composite signal by said transmitter facility;

said receiver facility comprising means for receiving the composite signals from said transmitter facility;

means for identically decoding the encoded auxiliary signal to provide a decoded auxiliary signal at said receiver end identical to said auxiliary signal before encoding at said transmitter end; and interrupter means coupled to said receiver means and to said auxiliary signal decoder means for suppressing said filling signals responsive to said decoded auxiliary signal.

8. The device of claim 7 wherein said receiver facility is further comprised of means responsive to the code group received from the transmitter facility to operate said interrupter means.

9. Apparatus for the confidential transmission of signals comprising:

transmitter and receiver facilities;

said transmitter facility containing voice information;

means for generating filling signals;

first switch means coupled between said filling signal generating means and said voice signal transmitting means, said first switch means being normally open;

means operative during breaks and interruptions of the intelligence signals containing the voice information for generating an auxiliary signal;

said first switch means being responsive to said auxiliary signal for closing said first switch means whereby said filling signals are inserted in said breaks and interruptions;

means for encoding said filled voice signals and said auxiliary signal at the transmitter facility;

said filled voice signal encoding means including means coupled between said first switch means and said voice signal transmitting means for encoding said voice signals by interchanging the signal sections thereof prior to transmission;

said filling signal generating means coupled to said voice signal encoding means to receive and temporarily store said interchanged voice signal sections, said temporarily stored signals being reintroduced as said filling signals to said voice signal encoding means;

second switch means coupled to the output of said voice signal encoding means for interrupting the encoded filled voice signals a predetermined time interval after the cessation of each voice signal;

said encoded signals being transmitted as a composite signal by said transmitter facility;

said receiver facility comprising means for receiving the composite signals from said transmitter facility;

means for identically decoding the encoded auxiliary signal to provide a decoded auxiliary signal at said receiver end identical to said auxiliary signal before encoding at said transmitter end;

interrupter means coupled to said receiver means and to said auxiliary signal decoder means for suppressing said filling signals responsive to said decoded auxiliary signal;

time delay means responsive to the auxiliary signal received from said transmitter facility for immediately actuating said suppression means upon the initiation of the auxiliary signal and for delaying the energization of the suppression means a predetermined time after the termination of the auxiliary signal.

10. The apparatus of claim 9 wherein said voice encoding means comprises means for generating a first irregularly alternating code signal; and storage means for delaying said voice signal sections by constantly varying time intervals responsive to said first irregularly alternating code signal.

11. The apparatus of claim 10 wherein said auxiliary signal encoding means at said transmitter facility further comprises means for generating a second irregularly alternating code signal alternating independent of said first irregularly alternating code signal; and means for reversing the polarity of said auxiliary signal responsive to said second code signal.

12. The apparatus of claim 11 further comprising means at the transmitter facility for delaying at least one of the encoded voice and encoded auxiliary signals prior to their transmission.

13. The apparatus of claim 11 further comprising means for suppressing a limited frequency band of said encoded intelligence signal; means for generating an audio signal shifting between a first frequency and a second frequency within said limited frequency band responsive to the polarity of said encoded auxiliary signal, said shifting audio signal being transmitted with said encoded voice signal; said receiver facility further comprising means for recreating the auxiliary signals at said receiver facility responsive to the reception of said first and second audio signal generating means frequencies thereat.

14. The apparatus of claim 9, wherein said filling signal generating means further comprises delay means for temporarily storing said interchanged voice signal section; said delayed signal sections being coupled by said switch means to said encoding means and being re-encoded during said breaks and interruptions.

15. Apparatus for the confidential transmission of signals comprising:

transmitter and receiver facilities;

said transmitter facility containing voice information;

means for generating filling signals;

switch means coupled between said filling signal generating means and said voice signal transmitting means, said switch means being normally open;

means operative during breaks and interruptions of the intelligence signals containing the voice information for generating an auxiliary signal; said switch means being responsive to said auxiliary signal for closing said switch means whereby said filling signals are inserted in said breaks and interruptions;

first means for encoding said filled voice signal and said auxiliary signal at the transmitter facility; said first means comprising means for generating first and second irregularity alternating code signals, said first irregularity alternating code signal alternating independent of said second irregularly alternating code signal; means for reversing the polarity of said voice signals responsive to said first irregularly alternating code signal; and means for reversing the polarity of said auxiliary signal responsive to said second irregularly alternating code signal;

means for delaying at least one of the encoded voice and encoded auxiliary signals prior to their transmission;

said encoded signals being transmitted as a composite signal by said transmitter facility;

said receiver facility comprising means for receiving the composite signals from said transmitter facility; means for identically decoding the encoded auxiliary signal to provide a decoded auxiliary signal at said receiver end identical to said auxiliary signal for encoding at said transmitter end; and interrupter means coupled to said receiver means and to said auxiliary signal decoder means for suppressing said filling signals responsive to said decoded auxiliary signal

16. Apparatus for the confidential transmission of signals comprising:

transmitter and receiver facilities;

said transmitter facility containing voice information;

means for generating filling signals;

switch means coupled between said filling signal generating means and said voice signal transmitting means, said switch means being normally open; means operative during breaks and interruptions of the intelligence signals containing the voice information for generating an auxiliary signal; said switch means being responsive to said auxiliary signal for closing said switch means whereby said filling signals are inserted in said breaks and interruptions;

first means for encoding said filled voice signals and said auxiliary signal of the transmitter facility; said first means comprising means for generating first and second irregularly alternating code signals, said first irregularly alternating code signal alternating independent of said second irregularly alternating code signal; means for reversing the polarity of said voice signal responsive to said first irregularly alternating code signal; and means for reversing the polarity of said auxiliary signal responsive to said second irregularly alternating code signal;

means for suppressing a limited frequency band of said encoded voice intelligence signal; means for generating an audio frequency shifting between a first frequency and a second frequency within said limited frequency band responsive to the polarity of said encoded auxiliary signal;

said shifting audio signal being transmitted as a composite signal with said encoded voice signal by said transmitter facility;

said receiver facility comprising means for receiving the composite signals from said transmitter facility; means for recreating the auxiliary signals at said receiver facility responsive to the reception of said first and second audio signal generating means frequencies thereat; and interrupter means coupled to said receiver means and to said auxiliary signal recreating means for suppressing said filling signals responsive to said recreated auxiliary signal.

* * * * *